US009123228B2

(12) United States Patent
Morehead

(10) Patent No.: US 9,123,228 B2
(45) Date of Patent: Sep. 1, 2015

(54) SECURITY ALARM SYSTEMS AND METHODS FOR COLLECTING AND UTILIZING CONDITION DATA

(71) Applicant: Robert Bradford Morehead, Evanston, IL (US)

(72) Inventor: Robert Bradford Morehead, Evanston, IL (US)

(73) Assignee: LiveWatch Security, LLC, Evanston, IL (US)

( * ) Notice: Subject to any disclaimer, the term of this patent is extended or adjusted under 35 U.S.C. 154(b) by 29 days.

(21) Appl. No.: 14/021,313

(22) Filed: Sep. 9, 2013

(65) Prior Publication Data

US 2014/0070941 A1 Mar. 13, 2014

Related U.S. Application Data

(60) Provisional application No. 61/698,086, filed on Sep. 7, 2012.

(51) Int. Cl.
*G08B 29/00* (2006.01)
*G08B 29/14* (2006.01)

(52) U.S. Cl.
CPC ..... *G08B 29/14* (2013.01)

(58) Field of Classification Search
CPC ..... G08B 29/14; G08B 25/009; G08B 19/00; G08B 23/027
USPC ..... 340/514, 506, 539.26, 539.28, 601, 340/602, 870.01
See application file for complete search history.

(56) References Cited

U.S. PATENT DOCUMENTS

| | | | | |
|---|---|---|---|---|
| 8,896,436 | B1 * | 11/2014 | Morehead | 340/501 |
| 2007/0139183 | A1 * | 6/2007 | Kates | 340/521 |
| 2014/0266777 | A1 * | 9/2014 | Gettings et al. | 340/870.01 |

* cited by examiner

*Primary Examiner* — Toan N Pham
(74) *Attorney, Agent, or Firm* — The Watson I.P. Group, PLC; Jovan N. Jovanovic; Vladan M. Vasiljevic

(57) ABSTRACT

A security alarm system having a plurality of features. Among other features, the security alarm system includes a plurality of secondary sensors, which refers to sensors that sense conditions outside of the location. These sensors can provide data pertaining to conditions outside of the location, and may include radiation sensors, insect sensors, earthquake sensors, water level sensors, rain sensors and the like. Data can be obtained from a network of such sensors at various remote locations for purposes of forecasting, analyzing, planning, warning and the like.

15 Claims, 4 Drawing Sheets

SECURITY ALARM SYSTEMS AND METHODS FOR COLLECTING AND UTILIZING CONDITION DATA

CROSS-REFERENCE TO RELATED APPLICATION

This application claims priority from U.S. Provisional Patent Application Ser. No. 61/698,086 filed Sep. 7, 2012, entitled "Security Alarm Systems And Methods For Collecting And Utilizing Condition Data," the entire disclosure of which is hereby incorporated by reference in its entirety.

BACKGROUND OF THE DISCLOSURE

1. Field of the Disclosure

The disclosure relates in general to alarm systems, and more particularly, to alarm systems that are configured for use in homes or offices. The alarm systems of the present disclosure include a number of innovative sensors which receive data pertaining to conditions within the installation, or in the area of the installation. The data can be used individually from each installation, or can be gathered from a number of installations in a certain geographic area so as to compile regional data pertaining to any number of different conditions.

2. Background Art

The use of alarm systems is well known in the art. Typically, an alarm system is a customized or customizable set of sub-assemblies that are professionally or homeowner installed. In the past, alarm systems would include a plurality of sensors and a control module to which the sensors would be coupled. Generally, the control module would be connected to an outside telephone line (or a cellular service line). In the event of a security issue, the control module would, through the telephone line contact a call center or the local police and/or fire department automatically.

With the advent of more sophisticated electronics, a plurality of new sensors are commercially available, and functionality of the control modules has increased. In many instances, the control modules can be coupled to internal and external networks, allowing for remote programming and remote access. In addition, a number of the different available sensors can provide feedback as to the status of the home, which status can be remotely provided.

Despite the vast number of different sensors, security systems have generally not adopted the use of these, much less utilized the data that could be obtained from the same. For example, condition sensors that sense various conditions around the installation can be utilized for any number of different purposes, including, notification, planning, disaster relief, early warning and the like.

Thus, it is an object of the present disclosure to enhance the security system services and methods of operation so as to obtain data in the surroundings of an installation, and to utilize the data for purposes of the homeowner and to aggregate the data from different regions for any number of purposes (i.e., planning, forecasting and the like). This object, as well as other objects of the present disclosure will become apparent in light of the present specification, claims, and drawings.

SUMMARY OF THE DISCLOSURE

In one aspect, the disclosure is directed to one or more computer-readable media comprising computer executable instructions for providing notification of a secondary sensor of an alarm system to at least one service provider. The computer executable instructions perform the steps of: receiving data from a secondary sensor of the alarm system; analyzing the data received from the secondary sensor; determining whether a repair or inspection is required; determining a first service provider capable of the repair or the inspection; and sending a message to the first service provider.

In a preferred embodiment, the computer-readable media further includes computer executable instructions performing steps comprising: determining whether data harvesting is required; determining a second service provider desirous of receiving the data harvested; and sending the data to the second service provider.

In another preferred embodiment, the first service provider and the second service provider are the same service provider.

In another preferred embodiment, the step of analyzing the data received from the secondary sensor further comprises instructions for performing steps comprising: reviewing data received from a second secondary sensor In another preferred embodiment, the secondary sensor comprises one of a radiation sensor, an insect sensor, an earthquake sensor, a water level sensor, and a rain sensor.

Preferably, the first service provider is a service provider other than a central monitoring station of an alarm service provider.

In yet another preferred embodiment, the second service provider is a service provider other than a central monitoring station of an alarm service provider.

In another aspect of the disclosure, the disclosure is directed to a method for providing notification of a secondary sensor of an alarm system to at least one service provider. The method comprises the steps of: receiving data from a secondary sensor of the alarm system; analyzing the data received from the secondary sensor; determining whether a repair or inspection is required; determining a first service provider capable of the repair or the inspection; and sending a message to the first service provider.

In a preferred embodiment, the method further comprises the steps of: determining whether data harvesting is required; determining a second service provider desirous of receiving the data harvested; and sending the data to the second service provider.

In another preferred embodiment, the first service provider and the second service provider are the same service provider.

In another such preferred embodiment, the step of analyzing the data received from the secondary sensor further comprises the steps of: reviewing data received from a second secondary sensor.

Preferably, the secondary sensor comprises one of a radiation sensor, an insect sensor, an earthquake sensor, a water level sensor, and a rain sensor.

In another preferred embodiment, the first service provider is a service provider other than a central monitoring station of an alarm service provider.

In another preferred embodiment, the second service provider is a service provider other than a central monitoring station of an alarm service provider.

In yet another aspect of the disclosure, the disclosure is directed to a notification system associated with an alarm system comprising an alarm system positioned at a first location, the alarm system having a control module, a communication module coupled to the control module. At least one sensor is coupled to the control module and configured to be triggered upon sensing a predetermined condition. The communication module is configured to transmit an alarm event when the at least one sensor is triggered. At least one secondary sensor is configured to be triggered upon sensing a predetermined condition. The alarm system further includes a data analyzing component, a determination component, a second determining component, and a message sending component. The data analyzing component configured to analyze data received from a secondary sensor. The determination component is configured for determining as to whether a repair or an inspection is required. The second determining component is configured for determining as to a first service provider that is capable of the repair or the inspection. The message sending component is configured for sending a message to the first service provider about the data received from the secondary sensor.

In a preferred embodiment, the alarm system further includes a third determining component for determining as to whether data harvesting is required; a fourth determining component for determining as to a second service provider that is desirous of receiving the data harvested; and a second message sending component for sending a message to the second service provider about the data received from the secondary sensor.

In another preferred embodiment in such an aspect, the first service provider and the second service provider are the same provider.

In another preferred embodiment, the first service provider and the second service provider are other than the central monitoring station of an alarm company configured to receive the alarm event notification from the communication module.

BRIEF DESCRIPTION OF THE DRAWINGS

The disclosure will now be described with reference to the drawings wherein.

DETAILED DESCRIPTION OF THE DISCLOSURE

Figure 1:
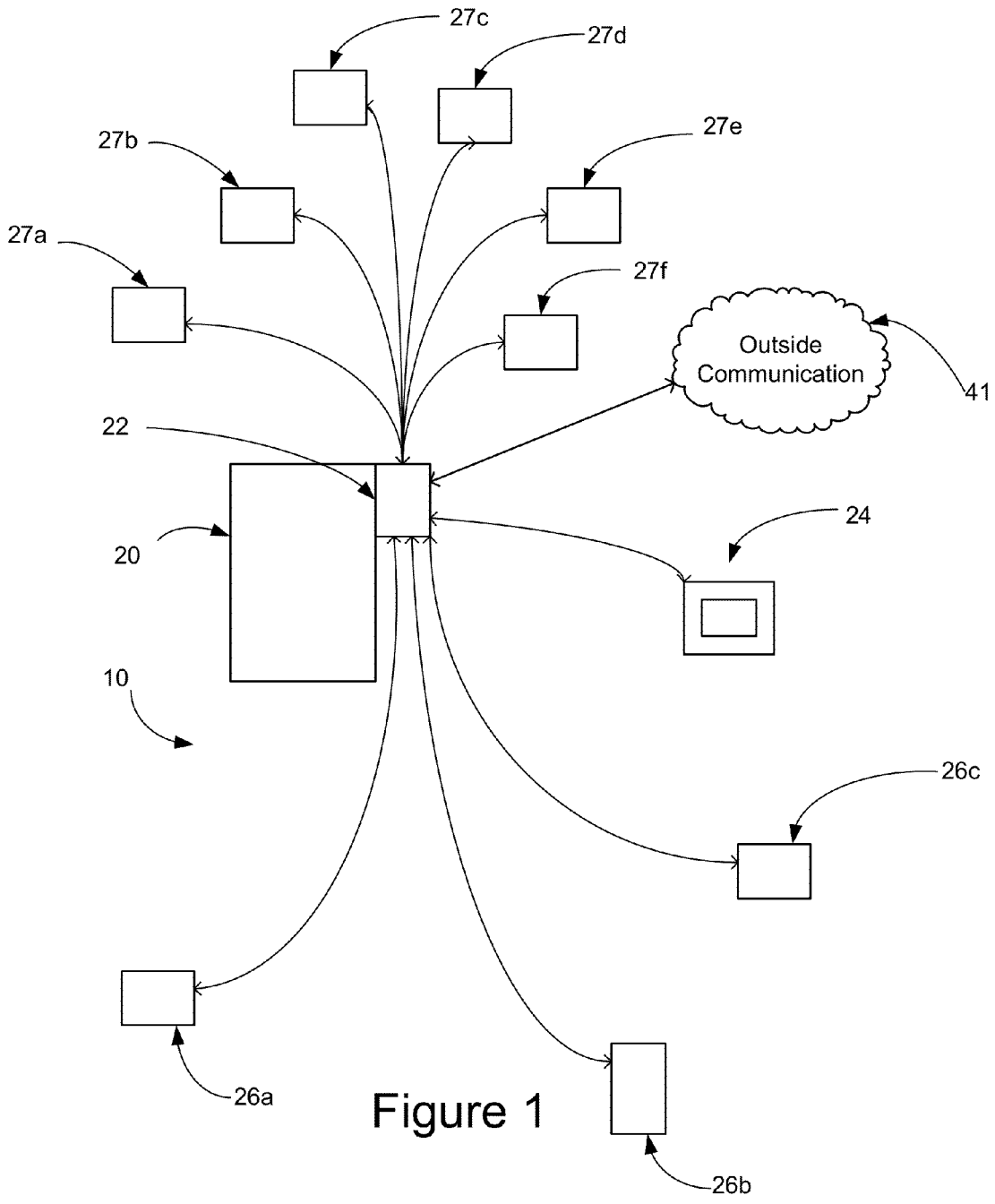
FIG. 1 of the drawings is a schematic representation of the alarm system of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the methods and systems are configured to work in association with an alarm system, such as alarm system 10. A typical alarm system includes a number of different components which work together. Of course, variations to the basic components, or combinations of the separate components are contemplated. Indeed, certain alarm systems may separate some of the components described below into discrete units, or may couple multiple components into a single component. However, it will be understood that typical alarm systems incorporate many if not all of the components that are identified.

Among the components the typical alarm system 10 is shown as comprising control module 20, communication module 22, programming module 24 and sensors (typically, multiple discrete sensors, such as sensors 26*a*-26*c* and secondary sensors 27*a*-27*e*). Generally, the control module 20 is positioned at or near the utility panel in a home or office setting, where it is accessible and also where other utility connections are present. It will be understood that the system 10 is operated under electrical power which can come from a standard plug being supplied AC (i.e., 110v, 60 Hz; 220V, 50 Hz, among others). It will also be understood that the system may be powered by a battery or may include a standby batter that can supply power to the system in the event that AC power has been disrupted. In other embodiments, the battery may be the only source, wherein the battery is recharged through any number of different means, including, but not limited to generators, wind towers and solar cells, among others. Indeed, with security systems, multiple redundancies may be incorporated to minimize successful sabotage.

The control module is essentially a computing device, as are the various computers and controllers which communicate with the control module 20, though outside communication 41. It will be understood that although not required, aspects of the descriptions below will be provided in the general context of computer-executable instructions, such as program modules, being executed by a computing device, namely the control module 20 along with other remote computing devices through outside communication. More specifically, aspects of the description below will reference acts, methods and symbolic representations of operations that are performed by one or more computing devices or peripherals, unless indicated otherwise. As such, it will be understood that such acts and operations, which are at times referred to as being computer-executed, include the manipulation by a processing unit of electrical signals representing data in a structured form. This manipulation transforms the data or maintains it at locations in memory, which reconfigures or otherwise alters the operation of the computing device or peripherals in a manner well understood by those skilled in the art. The data structures where data is maintained are physical locations that have particular properties defined by the format of the data.

Generally, program modules include routines, programs, objects, components, data structures, and the like that perform particular tasks or implement particular abstract data types. Moreover, those skilled in the art will appreciate that the computing devices need not be limited to a specialized security system control module (which may be highly proprietary), a conventional server computing racks or conventional personal computers, and include other computing configurations, including hand-held devices, multi-processor systems, microprocessor based or programmable consumer electronics, network PCs, minicomputers, mainframe computers, and the like. Similarly, the computing devices need not be limited to a stand-alone computing device, as the mechanisms may also be practiced in distributed computing environments linked through a communications network. In a distributed computing environment, program modules may be located in both local and remote memory storage devices.

Figure 3:
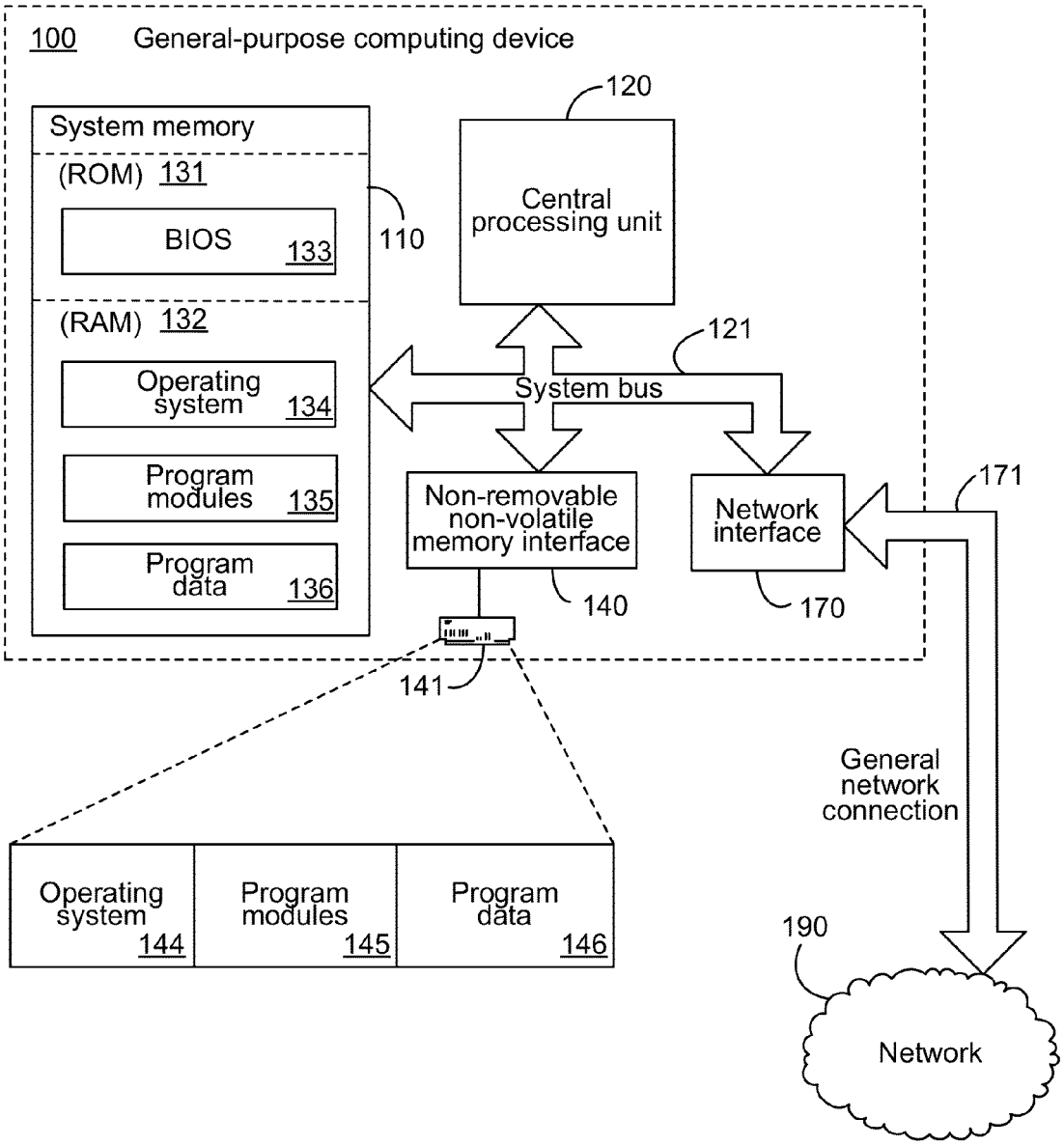
FIG. 3 of the drawings is a schematic representation of a computing device, a version of which may comprise the control module.

With reference to FIG. 3, an exemplary general-purpose computing device is illustrated in the form of the exemplary general-purpose computing device 100. The general-purpose computing device 100 may be of the type utilized for the control module 20 (FIG. 1) as well as the other computing devices with which control module 20 may communicate through outside communication 41 (FIG. 1). As such, it will be described with the understanding that variations can be made thereto. The exemplary general-purpose computing device 100 can include, but is not limited to, one or more central processing units (CPUs) 120, a system memory 130 and a system bus 121 that couples various system components including the system memory to the processing unit 120. The system bus 121 may be any of several types of bus structures including a memory bus or memory controller, a peripheral bus, and a local bus using any of a variety of bus architectures. Depending on the specific physical implementation, one or more of the CPUs 120, the system memory 130 and other components of the general-purpose computing device 100 can be physically co-located, such as on a single chip. In such a case, some or all of the system bus 121 can be nothing more than communicational pathways within a single chip structure and its illustration in FIG. 3 can be nothing more than notational convenience for the purpose of illustration.

The general-purpose computing device 100 also typically includes computer readable media, which can include any available media that can be accessed by computing device 100. By way of example, and not limitation, computer readable media may comprise computer storage media and communication media. Computer storage media includes media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by the general-purpose computing device 100. Computer storage media does not include communication media. Communication media typically embodies computer readable instructions, data structures, program modules or other data in a modulated data signal such as a carrier wave or other transport mechanism and includes any information delivery media. By way of example, and not limitation, communication media includes wired media such as a wired network or direct-wired connection, and wireless media such as acoustic, RF, infrared and other wireless media. Combinations of the any of the above should also be included within the scope of computer readable media.

When using communication media, the general-purpose computing device 100 may operate in a networked environment via logical connections to one or more remote computers. The logical connection depicted in FIG. 1 is a general network connection 171 to the network 190, which can be a local area network (LAN), a wide area network (WAN) such as the Internet, or other networks. The computing device 100 is connected to the general network connection 171 through a network interface or adapter 170 that is, in turn, connected to the system bus 121. In a networked environment, program modules depicted relative to the general-purpose computing device 100, or portions or peripherals thereof, may be stored in the memory of one or more other computing devices that are communicatively coupled to the general-purpose computing device 100 through the general network connection 171. It will be appreciated that the network connections shown are exemplary and other means of establishing a communications link between computing devices may be used.

The general-purpose computing device 100 may also include other removable/non-removable, volatile/nonvolatile computer storage media. By way of example only, FIG. 1 illustrates a hard disk drive 141 that reads from or writes to non-removable, nonvolatile media. Other removable/non-removable, volatile/nonvolatile computer storage media that can be used with the exemplary computing device include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140.

The drives and their associated computer storage media discussed above and illustrated in FIG. 3, provide storage of computer readable instructions, data structures, program modules and other data for the general-purpose computing device 100. In FIG. 1, for example, hard disk drive 141 is illustrated as storing operating system 144, other program modules 145, and program data 146. Note that these components can either be the same as or different from operating system 134, other program modules 135 and program data 136. Operating system 144, other program modules 145 and program data 146 are given different numbers here to illustrate that, at a minimum, they are different copies.

With reference to FIG. 1, again, the foregoing description applies to the control module 20, as well as to any other computing devices in communication with the control module 20 through outside communication 41. The control module 20 is coupled to the communication module 22. The communication module 22 facilitates outside communication in the form of voice and/or data. For example, the communication module may include a connection to a POTS line, or a VOIP line for voice communication. In addition, the communication module may be configured to couple into an existing network, through wireless protocols (Bluetooth, 802.11a, ac, b, g, n, or the like) or through wired (Ethernet, or the like) connections, or through other more generic network connections. In still other configurations, a cellular link can be provided for both voice and data (i.e., GSM, CDMA or other, utilizing 2G, 3G, and/or 4G data structures and the like). The communication module 22 may comprise a MiFi hotspot. The communication module is not limited to any particular protocol or type of communication. It is, however, preferred that the communication module be configured to transmit data bi-directionally, through at least one mode of communication. The more robust the structure of communication, the more manners in which to avoid a failure or a sabotage with respect to communication in an emergency.

The programming module 24 comprises a user interface which can configure the system. In many instances, the programming module 24 comprises a keypad with display that is connected through a wired connection with the control module 20. Of course, with the different communication protocols associated with the communication module 22, the programming module 24 may comprise a wireless device that communicates with the control module 20 through a wireless communication protocol (i.e., Bluetooth, RF, WIFI, etc.). In other embodiments, the programming module 24 may comprise a virtual programming module in the form of software that is on, for example, a smartphone, in communication with the communication module 22. In still other embodiments, such a virtual programming module may be located in the cloud (or web based), with access thereto through any number of different computing devices. Advantageously, with such a configuration, a user may be able to communicate with the security system remotely, with the ability to change functionality.

A plurality of sensors 26*a* through 26*c* can be coupled to the control module in either a wired or wireless configuration.

It will be understood that the sensors are shown schematically as being coupled to the communication module with a line having arrows at both ends; such a configuration signifies a communication link, which may be wired or wireless. The sensors, for example, may include typically known sensors used in association with security systems. For example, a motion sensor may be employed in certain areas. Such motion sensors are well known in the art. Other types of sensors include glass breaking sensors, door and window sensors (contact closure switches), light sensors, occupancy sensors, perimeter sensors, temperature sensors. Other sensors, such as temperature, pressure, smoke, water leak, carbon monoxide sensors and the like may also comprise sensors for purposes of the present disclosure. Indeed, there is no limit to the different sensors that can be utilized with the system. Additionally, cameras may be employed and coupled to the control module as another type of sensor under the present disclosure.

Figure 2:
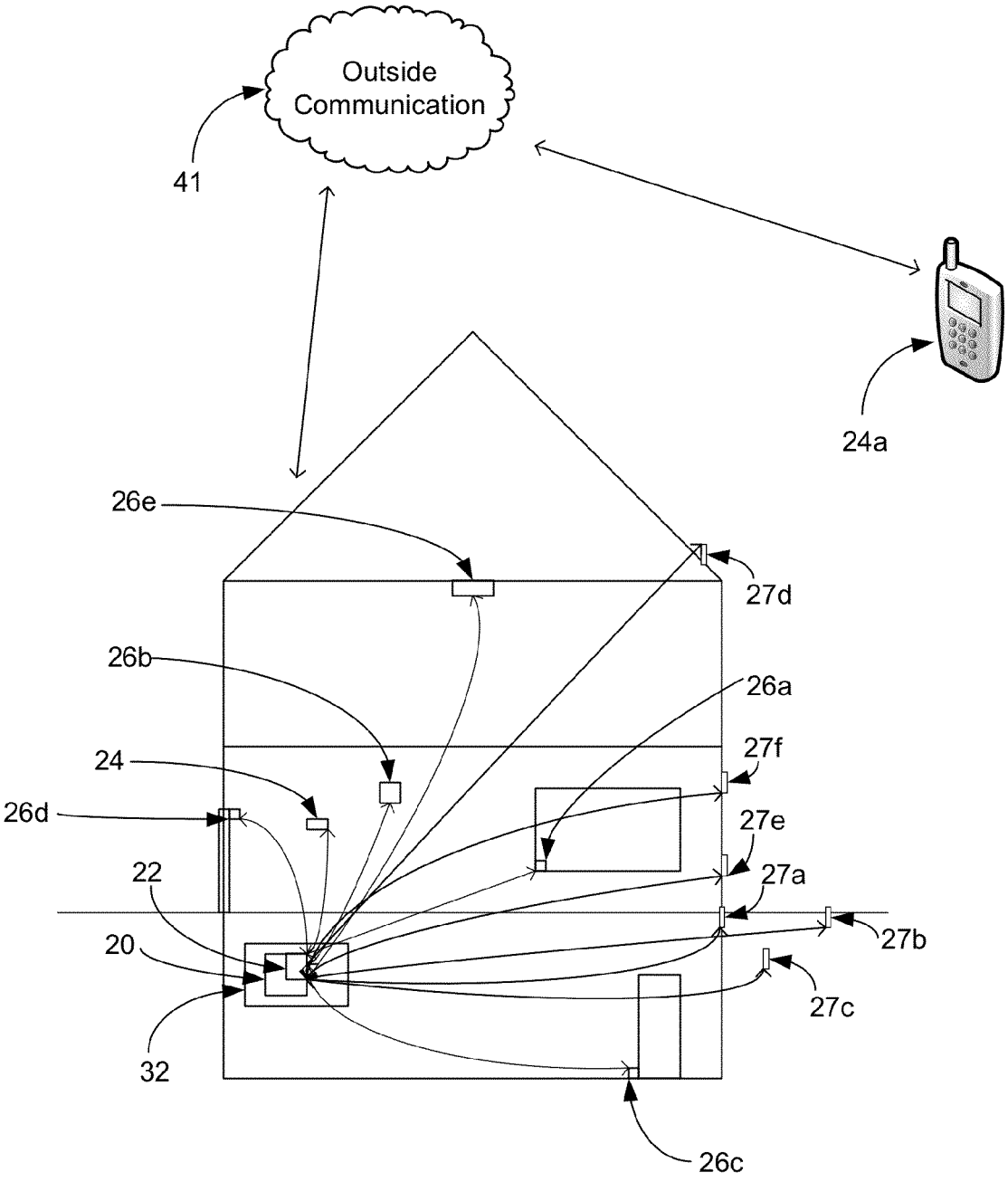
FIG. 2 of the drawings is a schematic representation of the alarm system of the present disclosure installed within a building structure.

With the basic architecture of the alarm system disclosed above, reference is directed to FIG. 2, which discloses a typical installation. The typical installation is disclosed with the understanding that any number of different configurations and installations may be employed. Additionally, it will be understood that the particular described installation is only exemplary and is not deemed to be limiting. Of course, a limitless amount of variations are contemplated.

With continued reference to FIG. 2, a typical installation is shown within a home. Such a typical installation includes the control module 20 being attached to a fixed structure (such as a utility panel 32 in, for example, a basement utility area). The control module 20 is energized through a conventional AC power supply (which may be internal or external). There is provided an additional battery back-up in the event of a power failure or the like.

The communication module 22 is electronically coupled to the control module. The communication module 22 is often mounted within the same assembly as the control module, and may include any number of different communication protocols, as set forth above. Most commonly, a cellular communication, coupled with a network connection (wired or wireless) is contemplated. As such, communication with the control module can be accomplished through the communication module remotely through any one of those communication protocols. Additionally, when necessary to communicate with the security monitoring company, the police department, the fire department, or other agencies, the communication module 22 provides the requisite hardware to effectuate such communication. Furthermore, the communication module provides the requisite hardware to communicate with some of the wireless sensors that may be utilized throughout the installation.

In the particular embodiment, a programming module 24 is positioned remote from the control module 20 within the installation. More specifically, the programming module is located on the main floor of the home in the exemplary configuration. Additionally, the programming module, in this instance, is hard wired to the control module and can control the functionality of the control module 20. Additionally, another programming module 24 is shown on smartphone 24*a* which communicates with the control module 20 through outside communication 41 (i.e., the Internet). With such a smartphone programming module 24*a*, the user can remotely program the control module from the smartphone, using a web interface or a dedicated program on the smartphone. Of course, other computing devices can also communicate with the control module remotely, and the use of a smartphone is for exemplary purposes only.

A plurality of sensors 26 are provided within the home. In the present example, a glass break sensor 26*a* is positioned on or near one of the glass windows on the main floor of the home. Additionally, a motion sensor 26*b* is positioned in a central location on the first floor of the home. Further, a water sensor 26*c* is positioned proximate the water heater in the basement of the home. A door contact sensor 26*d* is associated with the front entry door. A smoke detector sensor 26*e* is positioned centrally within the home. Of course, a number of other sensors can likewise be positioned throughout the home; the sensors shown are merely exemplary of some of the sensors that can be positioned within a home.

Conventionally, a tripping or activation of anyone of these sensors can cause the system contact the security system provider call center and/or local authorities. For example, should any one of the sensors 26*a*, 26*b*, 26*d* be triggered or activated, security systems generally contact a call center which then determines the appropriate party to call, including, but not limited to the homeowner, the police department, the fire department, or an ambulance service. Thus, calls generally proceed through a call center, wherein the call center individual decides the appropriate action.

In addition to the general sensors that are typically associated with alarm systems, such as those identified above, a plurality of secondary sensors 27*a*-27*d* may likewise be included in the system. While these are termed secondary sensors, the sensors are typically coupled to the system in a manner similar to or identical to the sensors 26. It will be understood that these sensors are termed secondary sensors 27, only for purposes of convenience to differentiate the same from the sensors 26.

The secondary sensors include, but are not limited to, Geiger counter (radiation sensor) 27*a*, insect (ant, termite) sensor 27*b*, earthquake (seismograph sensor) 27*c*, temperature sensor 27*d*, water level sensors 27*e*, rain sensors 27*f*, and the like. Indeed, the foregoing are merely exemplary of the types of sensors that can be utilized, and are not to be deemed limiting.

Such sensors, it will be understood, provide an indication as to the condition of the surroundings, or conditions that may be over a wider demographic. The data obtained from each sensor in each such home can be coupled to other sensors in similar localities to determine broader conditions.

At the outset, it will also be understood that while the system has a battery backup system, the system is configured to provide an alert in the event that utility service is not provided to the system. In the event that power is not being received by an alarm system, data pertaining to the same is sent to a central control system at, for example, an alarm monitoring company. The alarm monitoring company can then see if other installations in the area are experiencing the same lack of power. If so, then the system can conclude that a power outage has occurred, and can then notify the proper authorities relative to the same.

For example, the radiation sensor 27*a* can provide the homeowner with data pertaining to radon in the home. The radiation sensor can likewise provide valuable data in the event of disasters or potential disasters, such as, a release of radiation from, for example, a nearby power plant, or a disaster (such as a local spill or otherwise). While such disasters may be limited in their occurrences, a multitude of such sensors scattered amongst a number of alarm systems in a particular geographic area can provide realtime radiation readings, as well as be indicative to the spread of radiation. Such information can provide authorities with the data necessary to determine predictions as to which areas may be affected, as well as the rates of dissipation and the like.

Similarly earthquake sensor 27*c* can provide data pertaining to the effect of an earthquake at the location. While authorities have a plurality of sensors, obtaining data from a number of localized sensors can provide the authorities instrumental data. This data can be used to model the propagation of waves through the ground in a local area, providing indirect information as to the soil and ground conditions. In addition, such data can aid in the modeling of disasters in an area, which data can then be utilized to plan for emergency responses and to plan for various alternative strategies.

Similarly, with the rain sensor 27*d* and the water level sensor 27*e*, these sensors can be placed in strategic locations around a home, and can provide data pertaining to rainfall and water level. The data from these sensors can provide weather forecasters, for example, with accurate and plentiful data pertaining to rainfall in an area. Additionally, these sensors can provide much needed flood data and water height data for a given area, as well as data pertaining to the rate of change of the same. The data can be utilized to help coordinate rescue efforts and the like. Additionally, if there are enough data points (i.e., a proper concentration of sensors of a particular type in an area), trends can be seen, which can help with future planning (i.e., location of dykes, or levees and the like). Furthermore, with a plurality of sensors, it is possible to determine sensors that are not functioning properly, or that are giving readings outside of a particular range.

Finally, with a sensor such as insect sensor 27*b*, a homeowner can be provided an alarm as to potential damage to the home with sufficient warning to minimize any extensive insect damage. In many parts of the country, termites and carpenter ants can cause extensive damage quickly, yet quietly, without the homeowner even knowing the existence of the problem, much less the severity of the problem. By coupling such a sensor to the alarm system, early warning is provided of potential infestations of insects.

With any such sensors, it will also be understood that with the data that is obtained, projections or determinations can be made as to the extent of the problems or issues. For example, with the flood sensors, early warning can be provided to other areas of an impending disaster. Such early warning can make the difference in times of disaster. Early warning can allow residents of a yet to be affected area to evacuate or seek shelter with time to spare.

In addition to notifying the authorities based on data collected from the sensors, and warning homeowners, the data has other intrinsic value. For example, long range planning can take into account the data received from the various sensors over time (i.e., creating a wealth of information pertaining to different seasons, and different conditions). Such data is likewise useful for researchers in various fields, including, but not limited to geography, weather, climate, engineering, and the like.

Additionally, the data has value from an target audience standpoint, and from advertisers. For example, in the event of the triggering of the insect sensor, data pertaining to the homeowner can be directed to service organizations, such as pest control companies that can send information, solicitations, coupons and the like. As such, the efforts of the pest control company are specifically targeted to likely customers.

Similarly, in the event that a water level sensor is triggered, data pertaining to the homeowner can be directed to service organizations, such as a service organization that is in the cleaning business, and in particular, the disaster cleaning business. The foregoing are merely examples and are not to be deemed limiting.

It will be understood that each of the above features can be implemented through the computing device described above, or through a network of the computing devices, working in concert with the alarm system which is contained in the home. The implementation is achieved through the writing of code and the execution of same on the computing device to achieve the different methods and features explained herein. One of skill in the art having the present disclosure before him would understand how such features and methods are implemented through the use of a computing device and the execution of written code. It is contemplated that the alarm panel may include its own MiFi hotspot and the like and may function as the backbone of the connectivity for the alarm system and for the entire home.

Figure 4:
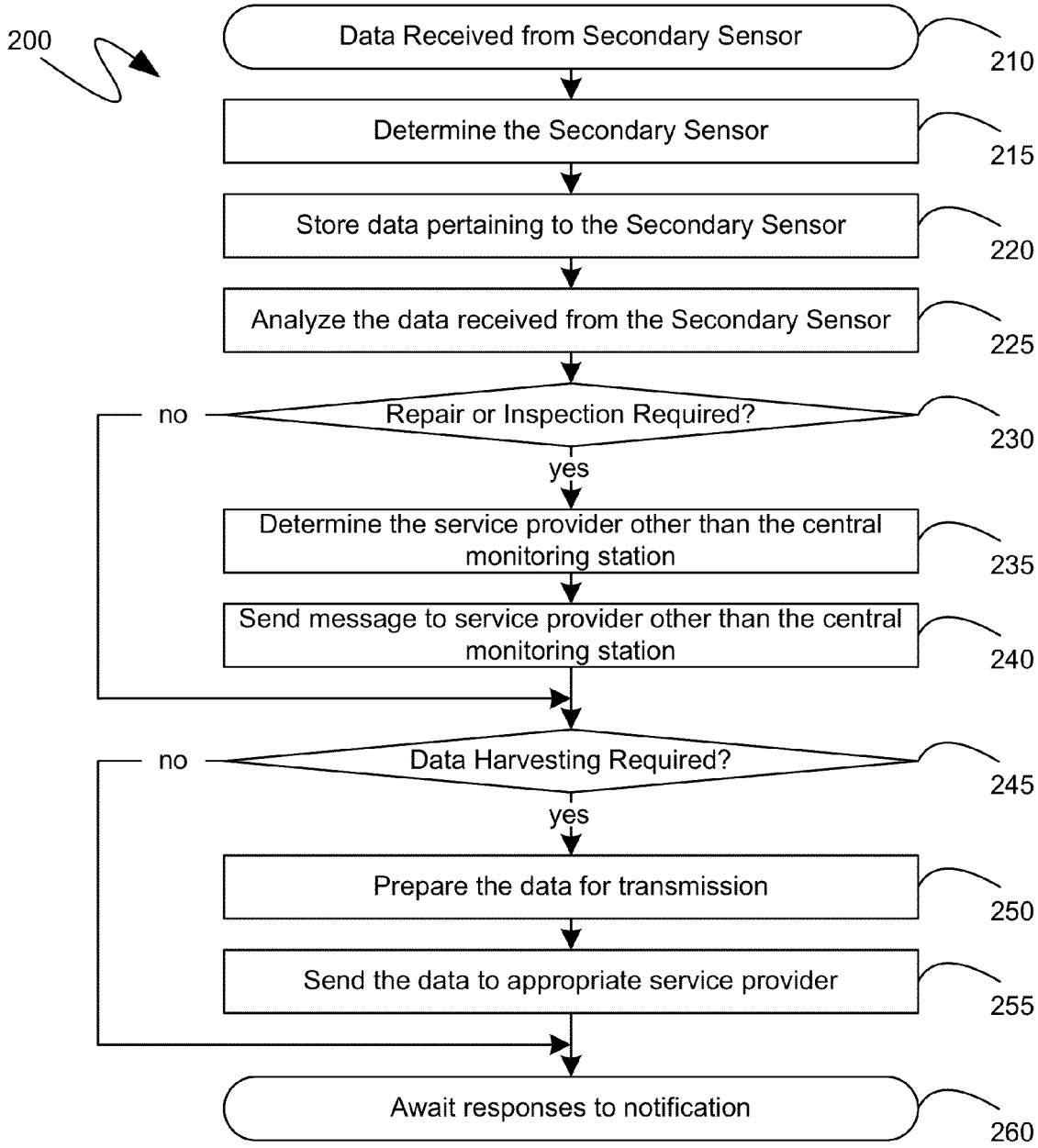
FIG. 4 of the drawings is an exemplary flow chart showing an exemplary process associated with the secondary sensor.

An exemplary flow chart is shown in FIG. 4 at 200. At step 210, the data is received from the secondary sensor. The system, at step 215 determines as to the nature of the secondary sensor, and data received from the secondary sensor is stored at the step 220. The data that is received may be received in a number of different formats and in an number of different manners. The storage of the data can be stored in volatile or non volatile memory. The data can then be analyzed by the system at step 225 to determine any necessary actions that are to be taken by the system relative to the trigger of the secondary sensor.

At step 230, the system determines as to whether a repair or an inspection of the premises is required. Such a repair or inspection is generally undertaken by someone other than the central monitoring station. For example, and as will be described below, a separate company (such as a pest control company, a flood clean-up company, etc.) may be contracted to respond to requests for repair and/or inspection. At step 235, the system determines the most appropriate contact for the repair or inspection. And, at step 240, that other individual is contacted.

In other instances, while no repair or inspection is required, data pertaining to the secondary sensor is valuable to a third party service provider. At step 245, the system determines as to whether data harvesting is required, and if so, at step 250, the system prepares the data for transmission. That is, the data can be incorporated or translated into different formats, compressed, error corrected, etc. Once the data is manipulated as needed, the data can be sent to the appropriate service provider at step 255. Finally, the system awaits a response to the notification at step 260.

In addition, it will be understood that the user may be informed through any number of different means (i.e., email, text, voice, etc.) as to any one or more of the steps being undertaken being undertaken. For example, the user may be informed of the triggering of the secondary sensor, and the confirmation that a message has been sent to the appropriate outside service provider. In other instances, the user may be informed to a greater or lesser degree.

In certain instances, a secondary sensor is triggered that requires both repair or inspection, or data harvesting. In such an instance, the system will contact an outside service provider relative to repair or inspection, and, also provide data to an outside service provider. In certain instances, the two providers may be distinct. That is, the outside service provider to which repair or inspection information is sent is unrelated to the service provider that is harvesting the data.

In one example, the secondary sensor comprises an earthquake sensor. Such a secondary sensor is triggered in the event of a seismic event. In the event of the triggering of such a sensor, the system determines the sensor data. In analyzing the data, the system may be able to determine, based on the data received from the sensor, the magnitude of the seismic event. Regardless of the magnitude of the seismic event, the system will prepare the data for transmission and transmit the data to an appropriate data collection agency (such as the national weather service, for example) for purposes of data harvesting.

In addition, should the magnitude of the seismic event be at or above a particular value, the system may determine that it is necessary to also contact a service provider to inspect the home or building to check for any damage due to the seismic event. In such an instance, the system determines the appropriate provider to contact. The provider is then contacted. In such an embodiment, the system only notifies the provider relative to a repair or an inspection if the seismic event is above a particular value.

In another embodiment, the system may include a rain sensor. The rain sensor determines precipitation (for example, both the existence of rain/snow and the quantity fallen over a period of time). Such a sensor may transmit data to a service provider for purposes of data harvesting.

In the event that the rain sensor has indicated high levels of precipitation, and a flood sensor has indicated a flood event in an area (such as a basement or the like), the system may determine that a flood condition exists based upon outside conditions. Appropriate outside service providers can be contacted to repair damage from the flood (and additionally, may contact service providers that can provide preventative services, such as sump pump installation and service, home landscape and drainage service providers, etc.). On the other hand, if the flood sensor has indicated an event, but the rain sensor has not shown much in the way of precipitation, the system may determine that an event within the home is causing the alarm condition with respect to the flood sensor. The system can then contact the appropriate service provider for a flood condition within the home (a cleaning crew and, also, perhaps, a plumber).

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. One or more computer-readable storage media comprising computer executable instructions for providing notification of a secondary sensor of an alarm system to at least one service provider, the computer executable instructions when executed by a computing device performing steps comprising:

receiving data from a secondary sensor of the alarm system;

analyzing the data received from the secondary sensor;

determining whether a repair or inspection is required;

determining a first service provider capable of the repair or the inspection;

sending a message to the first service provider;

determining whether data harvesting is required;

determining a second service provider desirous of receiving the data harvested; and sending the data to the second service provider.

2. The computer-readable media of claim 1 wherein the first service provider and the second service provider are the same service provider.

3. The computer-readable media of claim 1 wherein the step of analyzing the data received from the secondary sensor further comprises instructions for performing steps comprising:

reviewing data received from a second secondary sensor.

4. The computer-readable media of claim 1 wherein the secondary sensor comprises one of a radiation sensor, an insect sensor, an earthquake sensor, a water level sensor, and a rain sensor.

5. The computer-readable media of claim 1 wherein the first service provider is a service provider other than a central monitoring station of an alarm service provider.

6. The computer-readable media of claim 1 wherein the second service provider is a service provider other than a central monitoring station of an alarm service provider.

7. A method for providing notification of a secondary sensor of an alarm system to at least one service provider, the method comprising the steps of:

receiving data from a secondary sensor of the alarm system;

analyzing the data received from the secondary sensor;

determining whether a repair or inspection is required;

determining a first service provider capable of the repair or the inspection;

sending a message to the first service provider determining whether data harvesting is required;

determining a second service provider desirous of receiving the data harvested; and sending the data to the second service provider.

8. The method of claim 7 wherein the first service provider and the second service provider are the same service provider.

9. The method of claim 7 wherein the step of analyzing the data received from the secondary sensor further comprises the steps of:

reviewing data received from a second secondary sensor.

10. The method of claim 7 wherein the secondary sensor comprises one of a radiation sensor, an insect sensor, an earthquake sensor, a water level sensor, and a rain sensor.

11. The method of claim 7 wherein the first service provider is a service provider other than a central monitoring station of an alarm service provider.

12. The method of claim 7 wherein the second service provider is a service provider other than a central monitoring station of an alarm service provider.

13. A notification system associated with an alarm system comprising:

an alarm system positioned at a first location, the alarm system having a control module, a communication module coupled to the control module, at least one sensor coupled to the control module and configured to be triggered upon sensing a predetermined condition, with the communication module configured to transmit an alarm event when the at least one sensor is triggered, at least one secondary sensor configured to be triggered upon sensing a predetermined condition, the alarm system further including:

a data analyzing component configured to analyze data received from a secondary sensor;

a determination component for determining as to whether a repair or an inspection is required;

a second determining component for determining as to a first service provider that is capable of the repair or the inspection;

a message sending component for sending a message to the first service provider about the data received from the secondary sensor a third determining component for determining as to whether data harvesting is required;

a fourth determining component for determining as to a second service provider that is desirous of receiving the data harvested; and a second message sending component for sending a message to the second service provider about the data received from the secondary sensor.

14. The system of claim 13 wherein the first service provider and the second service provider are the same provider.

15. The system of claim 14 wherein the first service provider and the second service provider are other than the central monitoring station of an alarm company configured to receive the alarm event notification from the communication module.

* * * * *